US005457440A

United States Patent [19]

Daddono

[11] Patent Number: 5,457,440

[45] Date of Patent: Oct. 10, 1995

[54] PERSONAL SECURITY DEVICE AND METHOD OF ATTACHING SAME

[76] Inventor: Mary Daddono, 119 Kenmore Ave., Apt. E, Elmhurst, Ill. 60126

[21] Appl. No.: 241,138

[22] Filed: May 10, 1994

[51] Int. Cl.[6] ..... G08B 23/00

[52] U.S. Cl. ..... 340/573; 340/539; 340/572

[58] Field of Search ..... 340/539, 568, 340/571, 572, 573, 988

[56] References Cited

U.S. PATENT DOCUMENTS

| | | | |
|---|---|---|---|
| 3,818,897 | 6/1974 | Smith | 40/21 R |
| 4,233,715 | 11/1980 | McDermott | 40/21 C |
| 4,328,978 | 5/1982 | McLaughlin | 283/7 |
| 4,694,284 | 9/1987 | Leveille et al. | 340/573 |
| 4,736,196 | 4/1988 | McMahon et al. | 340/573 |
| 4,777,477 | 10/1988 | Watson | 340/573 |
| 4,812,823 | 3/1989 | Dickerson | 340/572 |
| 4,847,592 | 7/1989 | Hogen Esch et al. | 340/572 |
| 4,952,913 | 8/1990 | Pauley et al. | 340/573 |
| 4,980,671 | 12/1990 | McCurdy | 340/573 |
| 5,014,040 | 5/1991 | Weaver et al. | 340/572 |
| 5,115,223 | 5/1992 | Moody | 340/539 |
| 5,196,825 | 3/1993 | Young | 340/573 |

*Primary Examiner*—Brent A. Swarthout
*Attorney, Agent, or Firm*—Mathew R. P. Perrone, Jr.

[57] ABSTRACT

An alarm assembly is held in place on a child by an adjustable length belt having an alarm device combined with an identification device secured thereto.

4 Claims, 3 Drawing Sheets

PERSONAL SECURITY DEVICE AND METHOD OF ATTACHING SAME

This invention relates to the field of security and a child security device, and more specifically to child security device including a cable belt which can only be removed by an authorized staff person using a detaching mechanism after proper identification is presented.

BACKGROUND OF THE INVENTION

With shopping malls, amusement parks, arcades and similar places which attract a crowd available to almost every community, the opportunity presents itself for a child to become lost. An even worse scenario, which may occur, is a kidnapping. It is extremely desirable to prevent these problems from occurring in the first place. In the event of such an occurrence, it is also desirable to solve the problems associated therewith as efficiently as possible.

A lost child creates several problems. One problem involves how to properly identify the person to whom the child is returned. Another problem involves how to keep the child from leaving the area. If the child can be contained within a known area, location of the child is greatly simplified.

A kidnapped child creates greater problems than a lost child. The most serious problem is the emotional trauma. Anything that can assist a quick recovery of a kidnapped child has a great advantage in reducing that trauma. Yet, the stealth used by the criminal inherently causes a problem with a quick recovery.

One problem caused is the covert effort to conceal the child. There is at least one documented case of a kidnapped child having a changed appearance due to a haircut and other activities within minutes of the abduction. Another problem is efficiently providing for the quick location of the criminals to avoid harm to the child and to capture the criminal.

Such problems are not limited to a child. It is also desirable to control the whereabouts of a nursing home patient. It is not possible to watch every patient all the time. Yet, if a patient wanders from the controlled area, it is desirable to alert a staff member as soon as possible. Still, it is also desirable to provide controlled removal of such a device.

Such problems are more likely to be solved if the solution is simple and efficient. Minimal cost of a device is also an advantage, because it encourages the installation of that device to provide a solution.

Other than instructions to be alert to an otherwise preoccupied security force, there is no organized effort made by the store, mall, nursing home or other security forces to at least deter this type of problem.

SUMMARY OF THE INVENTION

Among the many objectives of this invention is the provision of a security device with can be secured to a person for location and identification of the person with removal of the device only under special conditions.

Another objective of this invention is to provide a security device, which is easily attached to a person.

Yet another objective of this invention is to provide a security device, which an identification system therein.

Still another objective of this invention is to provide a security device, which is removable from the person by authorized personnel.

Additionally, an objective of this invention is to provide a method of attaching a security device to a person.

Also, an objective of this invention is to provide a security device which can assist with location of a child.

A further objective of this invention is to provide a security device, which is easily installed.

These and other objectives of the invention (which other objectives become clear by consideration of the specification, claims and drawings as a whole) are met by providing an adjustable length belt having an alarm device combined with an identification device secured thereto, and a method of securing the same to a person and especially a child.

BRIEF DESCRIPTION OF DRAWINGS

Throughout the figures of the drawings where the same part appears in more than one figure the same number is applied thereto.

DESCRIPTION OF PREFERRED EMBODIMENTS

Figure 1:
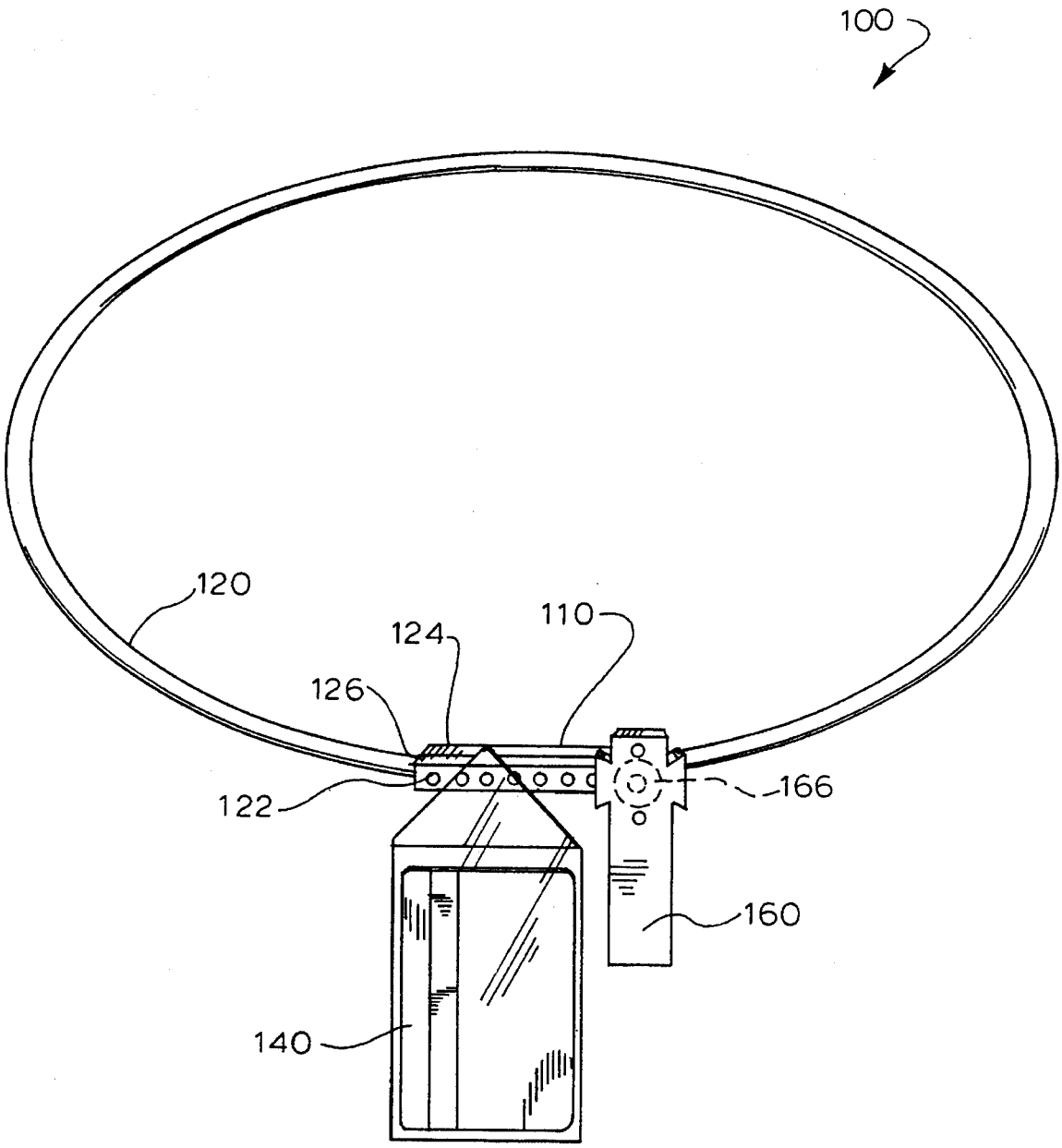
FIG. 1 depicts a perspective view of the security device 100 locked position 110 with cable belt 120 having identification card 140 and sensor 160 locked thereon.

The security device of this invention includes an adjustable belt, a locking device on each end of the belt and a restricted locking mechanism to cooperate with the locking device. The restricted locking mechanism includes a clamp with a sensor and an activating pin, which activates an alarm either when an unauthorized attempt at removal of the device occurs or when the device passes through a detecting device or other field of interrogation. The sensor also serves to identify the person to whom the child may be released.

More specifically, the belt includes a locking mechanism in the form of the sensor and activating pin. The clamp can lock the cable to desired size of the child or other person, while providing for the adjustment in the length thereof. The clamp can be placed around the waist or neck of the person or in any other suitable way as to make it irremovable. Preferably, the clamp is an eyelet clamp.

Before the clamp is locked, a special identification tag is attached at the clamp. Removal of the identification tag is required before the clamp can be opened. Likewise, if a person tries or is forced to leave a secured place with the security device in place, the in place security system is activated to sound an alarm, or lock a door. All pieces fit together and are attached onto cable belt.

The special identification tag includes a slot to receive a coded card. The possessor of the card has a claim on the person to whom the security device is attached.

In operation, as a parent and child enter a shopping mall, all identification cards are handed over to authorized security personnel. After the security personnel have confirmed that the parent identification card and the child identification card match, the cable belt is secured to or fitted around the child, adjusted to size, is fitted with the identification card and locked in place by the locking mechanism. Removal of the identification card and the belt can only occur when the parent or other person presents the matching identification card to the authorized security personnel. The identification card is similar to credit card or bank card with a magnetically readable strip or other device.

The identification tag is secured to the belt in any suitable fashion such as that set forth in U.S. Pat. No. 4,233,715 to McDermott. The alarm activation device can be similar to the device disclosed in U.S. Pat. No. 4,952,913 to Pauly et al.

The desired belt can be made of any substantially unbreakable of uncuttable material. Preferably, the belt is a three sixteenths (3/16) inch (0.47 centimeter) gage cable belt with eyelet ends to provide adjustable sizes. The cable belt may be coated in bright neon plastic, for easy viewing as an added safety factor. Such colors also make the belt more attractive to child wearing it.

The cable belt also has eyelets for adjusting the length thereof. Additionally, a magnetically encoded card similar to a credit card size in appearance (about 5.4 by 8.6 centimeters or about 2.125 by 3.375 inches) identification card mounted in a clear plastic sleeve. The plastic sensor (6.54 by 2.54 centimeters or 2.5 inches by 1 inch) is typically available under the Trademark Sensormatic Ultra-gator, Ultra Max, available from Sensormatic, Inc., 747 Church Road, Suite D-3, Elmhurst, Ill. 60126. Other equivalent devices are also operable.

This security device has components, which include a cable belt with adjustable eyelet ends, a clear plastic sleeve which holds a magnetically encoded identification card and a sensor which lock all pieces together. The identification card is magnetically encoded with a secret identification or pin number, that matches the parent identification number, and which slips into a clear plastic sleeve. Thus, the parent can take card belonging to the belt the child is wearing, and positively identify and retrieve a lost child.

The sensor is attached to the belt along with identification card and also acts as belt lock. A security belt with magnetically encoded identification card and sensor tag aids in the prevention of kidnapping and in the finding of lost children.

An identification card magnetically encoded with secret Pin number that matches parent identification card slips into a clear plastic sleeve and then is attached to the belt. A sensor that attaches identification card to belt and acts as a lock. It takes a substantial amount of pressure or to remove the belt this particular sensor. A special tool or detaching device, which is difficult to obtain, can apply desired pressure to remove the belt.

This sensor works off existing store security and is removed only by a hand-held, detaching device (available from Sensormatic, Inc.). All identification cards are read by magnetic reader before belt is used. This structure ensures that every child's card number matches the parent's card number. No security belt is provided without a card. If the identification card is lost or removed from plastic sleeve, security can be notified and child held until proper identification of the parent can be made.

This invention cannot be removed by an unauthorized person. Likewise, the child cannot be lured or conned into removing any part of device, without activating the device. This invention can only be removed by authorized staff making it difficult for anyone to walk off with a child. Also, this invention can make it easy to identify a lost child too young or too emotional to give proper information. Because this invention is usable used with existing store security, it can make malls, parks and arcades a safer environment for children.

The security belt includes a cable which can be adjusted to size, an identification card with a secret pin number encoded on it which matches parents identification card, a clear plastic sleeve which card will fit into and a 2 piece sensor which will act as security lock. The clamp adjusts the belt to the child's size and secures the belt to the child.

Figure 2:
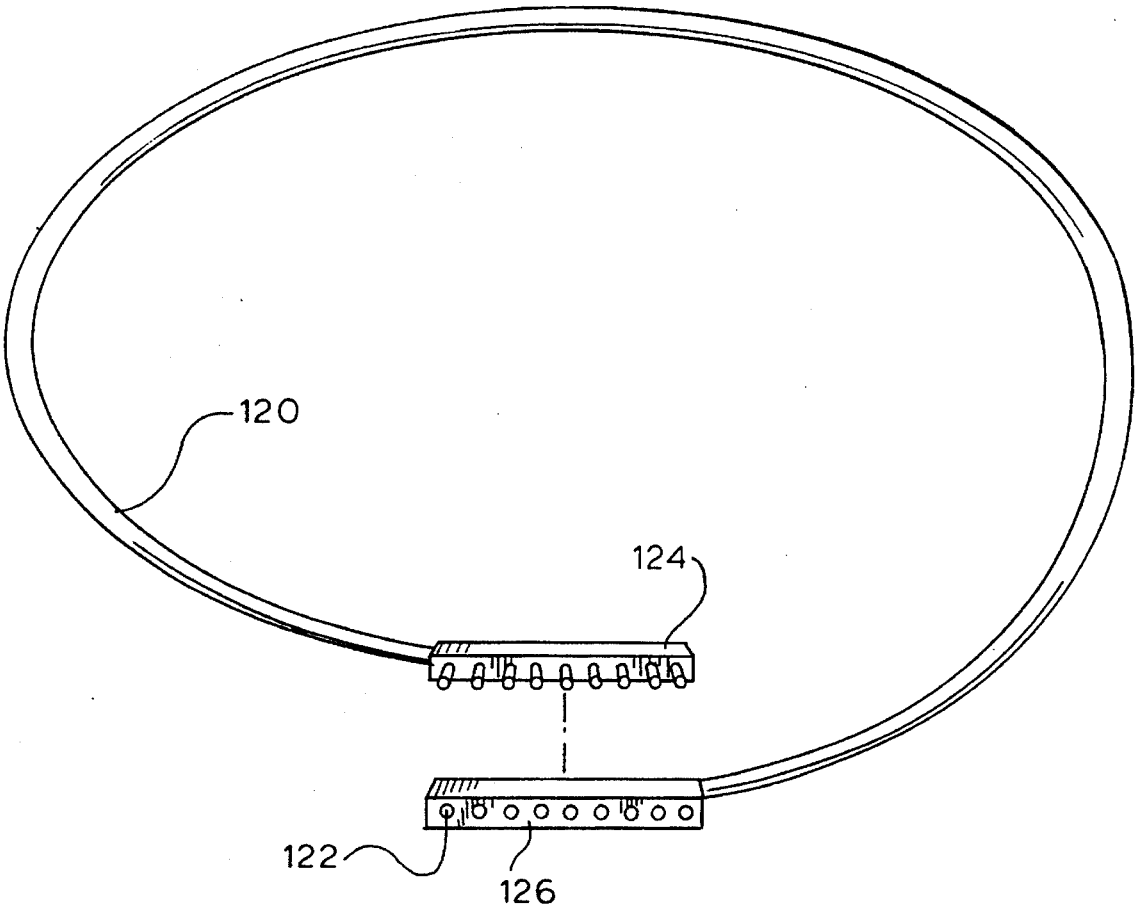
FIG. 2 depicts a perspective view of the cable belt 120 with eyelets 122 thereon to adjust the size thereof.

Referring now FIG. 1 and FIG. 2, a security device 100 is in locked position 110 with cable belt 120 having identification card 140 and sensor 160 locked thereon. Eyelets 122 provide for adjusting the length of the cable belt 120. Eyelets 122 include male eyelet assembly 124 and female eyelet assembly 126 which join and are locked in position by sensor 160 being secured thereon.

Figure 3:
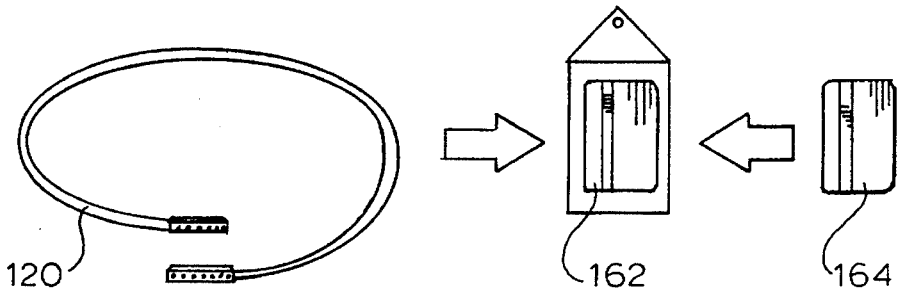
FIG. 3 depicts a view of cable eyelet 122 used with sensor 160 to be mounted thereon.
Figure 4:
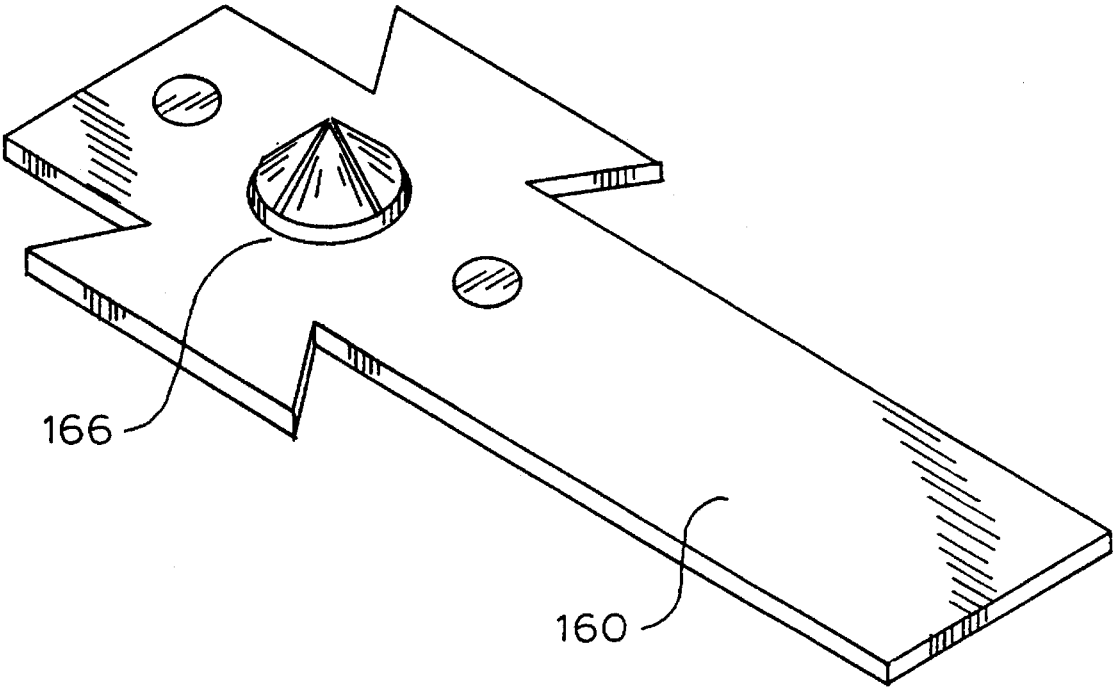
FIG. 4 depicts a perspective view of sensor 160 used with cable belt 120.

Adding FIG. 3 and FIG. 4 to the consideration, the cable belt 120 with eyelets 122 with a sensor 160 secured thereto. The sensor 160 responds to the standard detectors used at retail establishments. The magnetic reader 162 is usually located at the security desk for reading the encoded identification card 164. This encoded identification card 164 is used by a parent to identify the child wearing the security device 100.

Sensor 160 also includes a locking device 166 to secure the sensor 160 to eyelets 122. With the sensor 160 serving to lock the belt 120 in position while providing the alarm mechanism. The capability of this device 100 to cooperate with the security systems in place in most malls.

This application — taken as a whole with the specification, claims, abstract, and drawings — provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A wearable security device comprising:

a) a belt, an alarm device and an identification device cooperating to provide a positive identification for a child;

b) the alarm device being secured to belt;

c) the belt including means to adjust a length of the belt;

d) the identification device cooperating with the alarm device to provide a positive identification between a person wearing the belt and a person having the identification device;

e) the alarm device including means to lock the belt in place;

f) the means to lock including a clamp with a sensor and an activating pin mounted therein;

g) the sensor including means to cause noise when the belt is removed;

h) the alarm device including means to cooperate with a detecting device;

i) the means to adjust a length including a clamp;

j) the belt being formed of a cut resistant material;

k) the clamp being an eyelet clamp with means to adjust a length of the belt;

l) the clamp further including means to receive a coded card;

m) the coded card serving to provide an identity;

n) the sensor being compatible with the detecting device;

o) the clamp including a male eyelet assembly and a female eyelet assembly;

p) the male eyelet assembly being secured to a first end of the belt;

q) the female eyelet assembly being secured to a second end of the belt;

r) the male eyelet assembly joining the female eyelet assembly to secured the belt in place; and s) the first end of the belt being oppositely disposed from the second end of the belt.

2. The wearable security device of claim 2 further comprising:

a) the alarm device including means to lock the belt in place;

b) the means to lock including a clamp with a sensor and an activating pin mounted therein; and c) the sensor including means to activate the detecting device.

3. The wearable security device of claim 2 further comprising:

a) the belt being formed of a cut resistant material; and b) the clamp being an eyelet clamp with means to adjust a length of the belt.

4. The wearable security device of claim 1 further comprising the belt having a colored coating.

* * * * *